US006361610B1

(12) United States Patent
Scotto et al.

(10) Patent No.: US 6,361,610 B1
(45) Date of Patent: Mar. 26, 2002

(54) METHOD FOR CLEANING OR DECORING A CASTING

(75) Inventors: Alain Scotto, Massongy; Jean-Louis Janin, Fillinges, both of (FR)

(73) Assignee: Forward Technology Industries, Annemasse Cedex (FR)

( * ) Notice: Subject to any disclaimer, the term of this patent is extended or adjusted under 35 U.S.C. 154(b) by 0 days.

(21) Appl. No.: 09/527,851

(22) Filed: Mar. 17, 2000

(30) Foreign Application Priority Data

Mar. 23, 1999 (FR) ..... 99 03610

(51) Int. Cl.[7] ..... B08B 3/12
(52) U.S. Cl. ..... 134/1; 134/8; 134/22.12
(58) Field of Search ..... 134/1, 8, 20, 22.12, 134/22.18, 21, 34, 37

(56) References Cited

U.S. PATENT DOCUMENTS

| | | | | |
|---|---|---|---|---|
| 3,989,537 A | * | 11/1976 | Sickmeier | 134/1 |
| 4,082,566 A | * | 4/1978 | Arendt et al. | 134/21 |
| 4,381,577 A | | 5/1983 | Boye et al. | 15/304 |
| 4,823,513 A | * | 4/1989 | Marcus et al. | 134/1 |
| 5,071,487 A | | 12/1991 | McKibben et al. | 134/22.18 |
| 5,891,255 A | * | 4/1999 | Crick | 134/1 |
| 6,017,398 A | * | 1/2000 | Scotto et al. | 134/1 |

FOREIGN PATENT DOCUMENTS

| | | |
|---|---|---|
| FR | 2755038 | 4/1998 |
| WO | WO 96/24462 | 8/1996 |

* cited by examiner

*Primary Examiner*—Randy Gulakaowski
*Assistant Examiner*—Saeed Chaudhry
(74) *Attorney, Agent, or Firm*—Connolly Bove Lodge & Hutz LLP

(57) ABSTRACT

Method for cleaning or decoring a casting, wherein that, separately or in combination:

the said casting may be excited by an ultrasonic source of vibration, to allow residual material in contact with the walls of the said casting to become detached, this casting resting on a number of anvils placed on vibrating means supporting the casting and in contact with a number of sonotrodes, the said casting may be beaten at a very low frequency so as to cause large-sized internal residue such as a sand-based core insert to crack up, vibrating means may be used to impart a low-frequency linear vibration to this casting so as to break up and fluidize the cracked bits, the material issuing forth from the said casting may be extracted using a stream of fluid.

15 Claims, No Drawings

METHOD FOR CLEANING OR DECORING A CASTING

FIELD OF THE INVENTION

The present invention relates to a cleaning method for extracting foreign bodies (dust, sand, residual material, etc.) and dirt from inside hollow rigid containers, the complex and sinuous shape of which does not allow ready access to the areas that are to be cleaned. It is more specifically aimed at a method for cleaning metal parts advantageously intended for the automotive or aeronautic industry, such as gearbox housings, cylinder heads, engine blocks, manifolds, pump housings or any other parts, for example.

BACKGROUND OF THE INVENTION

These parts are generally obtained as castings and in most cases require the use of casting inserts.

Technical evolutions in these casting methods tends towards the use of parts of increasingly detailed and complex shapes, therefore requiring an increase in the density of the sand-based, ceramic or glass casting inserts, or the use of melting patterns, such as polystyrene patterns for example.

Whether the casting be using a casting insert or a lost pattern, the complexity of the internal passage means that, after the casting has been externally removed from the mould, an intact rather solid insert or residues of this pattern remain in the cavities of this casting.

Given that these parts are castings, residue of inserts or lost patterns, slag or even machining chips remain inside the lubrication cooling passages, and are extremely difficult to remove, even by low-frequency-vibration techniques or by the cavitation of liquid in an ultrasound tank, particularly since the liquid is no longer experiencing cavitation inside the small passages.

The traditional methods used for cleaning castings employ various techniques, such as low-frequency vibration, decoring by shaking using an unbalanced motor, or pneumatic, hydraulic and even mechanical beating, or alternatively the circulation of fluids at high pressure, the cavitation of a liquid in an ultrasound tank (the casting having previously been deposited in the tank), blasting with steel shot or ice or with plastic, or alternatively manual methods using scrapers or brushes, for example.

Thus, a known technique consists, for example, in using the method of exciting a casting according to the teaching of patent FR-2,755,038, this casting having previously been placed in a liquid-filled container.

When cleaning solid metal castings based essentially on aluminium or aluminium alloys which do not have the same kind of hardness as cast iron or steel, blasting techniques carry the risk of damaging the casting and what is more the shot cannot reach the ends of passages of small cross section, of which there are many in an engine cylinder head, for example.

It will be readily understood that manual techniques are not industrially transposable to the mass-production of parts.

BRIEF DESCRIPTION OF THE INVENTION

The present invention therefore sets out to alleviate these drawbacks by providing an industrial method which offers excellent cleaning efficiency, even in the nooks and crannies of a solid casting, and which is intended to detach, fluidize and extract any agglomerate trapped in the internal passages of the casting to be cleaned, such as, for example, a casting made using inserts or lost patterns, and guaranteeing the undeniable advantages of dry cleaning.

To this end, the method for cleaning or decoring a casting is characterized in that, separately or in combination:

- the said casting may be excited by an ultrasonic source of vibration, to allow residual material in contact with the walls of the said casting to become detached, this casting resting on a number of anvils placed on vibrating means supporting the casting and in contact with a number of sonotrodes,
- the said casting may be beaten at a very low frequency so as to cause large-sized internal residue such as a sand-based core insert to crack up,
- vibrating means may be used to impart a low-frequency linear vibration to this casting so as to break up and fluidize the cracked bits,
- the material issuing forth from the said casting may be extracted using a stream of gaseous fluid.

Other features and advantages of the present invention will emerge from the description given hereinafter.

According to a preferred embodiment of the method that is the subject of the invention, this method consists in performing the following steps separately or in combination:

- the casting is excited using a sinusoidal vibrational source at an ultrasonic frequency in a mean frequency range of the order, for example, of 10 to 30 kHz, preferably 15 to 20 kHz, so as to detach residual material in contact with the internal walls of the casting, this casting having been obtained by a casting method employing a sand-based or ceramic insert or a lost pattern (the "lost foam" technique), this casting in particular being placed on vibrating means such as a plate,
- the casting is struck with pneumatic or mechanical beating means at a very low frequency of the order of 0.1 to 5 Hz, for example, so as to cause large-sized internal residue such as a sand-based insert to crack up,
- the casting is vibrated using an electromagnetic source in a mean frequency range of the order of 100 to 250 Hz, for example, to disintegrate and fluidize the cracked bits,
- the fluid residue is extracted using a stream of air, for example, by controlled flow through the passages.

It goes without saying that these four steps, which in fact correspond to four different techniques, can be used in combination or simultaneously or in alternation in their entirety or partially according to the rheological condition of the residual insert material to be extracted.

DETAILED DESCRIPTION

The ultrasonic excitation sources are made up of sonotrodes with a diameter of 10 to 60 mm made of titanium or steel, tuned to a frequency of 10 to 30 kHz for a peak-to-peak amplitude of 40 to 150 $\mu$m, fixed to booster assemblies - piezoelectric or magnetostrictive transducers, and made to move by ultrasonic-frequency generators.

What is more, to optimize the transmission of the vibrational movement through the casting, given that this transmission depends essentially on the nature of the contact between each of the sonotrodes and the casting that is to be cleaned, it is necessary to control the sonotrode-casting coupling through a variation of the pressing force and through a variation in the amplitude of the ultrasonic vibrational movement. This sweep through pressures and amplitudes among other things guarantees that the casting will, periodically, pass through the optimum vibration condition in spite of differences in vibrational behaviour across a series of castings, these differences being associated with manufacturing spread.

The sonotrodes in contact with the casting can thus be controlled by imparting to them an oscillation or a pulsation at a frequency lower than the frequency of the ultrasonic source of the amplitude of vibration of these sonotrodes.

By way of example, excellent results have been obtained by controlling the sonotrodes in contact with the casting by imparting to them a low-frequency oscillation of the order of 0.5 Hz of the pressing force between two thresholds of between 100 and 1000 N established previously by testing the vibrational energy capabilities of the casting. This transmission of vibrational movement of the casting at the ultrasonic excitation frequency and at these natural frequencies of vibration also requires carefully located point excitations.

To achieve that, it is essential for metal anvils with a low contact area to be situated in opposition to the point of impact of the ultrasonic source and for this to be done with the smallest possible gap so as to guarantee point excitation while at the same time keeping most of the walls of the casting that is to be vibrated free of any vibrational movement. In order not to transmit the vibration to the structure of the machine and so as to maintain this freedom to vibrate, these anvils must be isolated from the chassis using a slightly elastic element such as a piece of polyurethane or a pneumatic actuator, just as must the sonotrode/booster/transducer acoustic assembly.

As an alternative, the variation in pressure needed for the frequency coupling of the casting may also be controlled by making the anvils oscillate.

All the conditions mentioned hereinabove are needed to obtain perfect detachment of the insert in its entirety or in the form of residue, by setting the walls of the casting that is to be cleaned into a vibrational movement.

The low-frequency excitation sources needed to crack up substantial masses of insert, as is particularly the case with sand inserts, are achieved using a very low frequency pneumatic beating system operating at a frequency of the order of 0.1 to 5 Hz.

The results in this instance depend essentially on the shockwave imparted to the casting, which therefore entails defining the conditions of contact between the beater and the casting, such as, in particular, the collision speed and onboard mass, this onboard mass being defined in proportion with the inherent mass of the casting that is to be cleaned including its insert or insert residue.

Beating may be imparted to the casting by at least one of the sonotrodes or at least one of the anvils supporting the said casting.

One judicious way of generating this movement needed for cracking is to use the pneumatic assemblies of the ultrasonic sources or of their anvils to obtain the desired beating by alternating the control of the pneumatic directional control valve(s), and adjusting the pressure and flow regulators.

The source of vibration needed to break up the residue until it is fluidized to allow it to be extracted comes from a linear vibration with a frequency of between 100 and 250 Hz, with a peak-to-peak amplitude of I to 4 mm, obtained using a mechanical system tuned to the chosen frequency and excited alternately by two electromagnets through a low-frequency generator.

This linear vibration may be oriented along a horizontal axis or along a vertical axis depending on the shape of the casting and the flow along the passages.

The casting needs to be securely fixed to the vibrating element from above or via one of the side faces so as to encourage gravity flow, that is to say flow from the bottom. Bearing in mind the fact that the insert is sometimes very heavy, particularly in the case of sand-based inserts, it is essential that the frequency generator be provided with automatic frequency control which firstly allows the latter to be tuned to the mechanical frequency of the vibrating assembly with the mass of the casting that is to be vibrated, and secondly allows the increase in this frequency in proportion with the loss of mass due to the outflow of the material gradually released to be followed in real time, with a view to optimizing the efficiency associated with the conversion of electromagnetic energy into mechanical energy.

The stream which conveys the material and broken-up insert residue is obtained using a combined blowing and suction system which guarantees the desired type of flow. For this, it is appropriate, for example, to use a suction system which guarantees a flow rate in excess of 20 m/s for example and, in particular, lying in the range from 20 to 80 m/s, for a flow rate corresponding to the cross sections of the passages that are to be cleaned out, and which will be judiciously supplemented by a blowing system supplied with compressed air by installing calibrated nozzles at the inlet of each orifice opposite the outlet or outlets connected to the suction.

This addition of compressed air has the purpose of compensating for the pressure drops associated with the sometimes tortuous paths of the passageways and has to be controlled upstream in terms of pressure and passage cross section so as to be equivalent to the rate of extraction by suction in order to avoid any overflow.

These suction and blowing systems need to be installed as close as possible to the orifices of the passages so as to restrict the intermediate volumes as far as possible in order to guarantee a minimum pressure drop and are, for example, located in a chamber enveloping just the casting or the vibration means, ultrasonic sources, beating means, particularly pneumatic or mechanical, and vibrating plate also. This chamber, which is kept at a reduced pressure, guarantees that the residue from the casting is removed. In the case of a bulky casting, it is necessary to reduce the volume subjected to the reduced pressure by limiting the passage of the stream to a space a few millimetres wide covering the entire external three-dimensional envelope of the casting.

Note that it may be very beneficial to increase the temperature of the circulating air to near to a temperature lying in a range from 50° C. to 200° C., preferably close to 80° C., when the residue would still be in a wet state, according to the various preventive treatments so as to optimize the quality of the outflow of this residue.

The present invention as described hereinabove offers numerous advantages because, by combining the phases of ultrasonic excitation, beating, vibration and removal of residue by a fluid, it guarantees that the casting is cleaned or decored optimally while at the same time reconciling the dictates associated with medium-scale and large-scale industrial mass production.

This method is likewise applicable as a control method to check the quality of the cleaning obtained using conventional techniques.

It remains clearly understood that the present invention is not restricted to the embodiments described and represented hereinabove, but that it encompasses all alternative forms thereof.

What is claimed is:

1. Method for cleaning or decoring a casting comprising the steps:

exciting said casting with vibration, to allow residual material in contact with the walls of said casting to become detached, the casting resting on a number of anvils, said casting being initially subjected to a very low frequency so as to cause large-sized internal residue to crack up, imparting a low-frequency linear vibration, in a higher range than the very low frequency, to the casting so as to break up and fluidize cracked bits, extracting the material issuing forth from said casting using a stream of fluid.

2. Method according to claim 1, wherein the casting is excited using a sinusoidal vibrational source at an ultrasonic frequency.

3. Method according to claim 1, wherein the casting is excited using a pulsed vibrational source at an ultrasonic frequency.

4. Method according to claim 1, wherein linear vibration frequency is chosen in the range from 10 to 30 kHz.

5. Method according to claim 1, wherein linear vibration frequency is chosen in the range from 15 to 20 kHz.

6. Method according to claim 1, wherein the very low frequency is between 0.1 and 5 Hz.

7. Method according to claim 6, wherein the very low frequency is produced by at least one sonotrode.

8. Method according to claim 6, wherein the very low frequency is produced by at least one anvil.

9. Method according to claim 1, wherein a frequency of linear vibration applied to the casting is in the range from 100 to 250 Hz.

10. Method according to claim 1, wherein the residue is extracted from the casting by the stream of fluid using combined blowing and suction, the flow rate of which is in the range from 20 m/s to 80 m/s.

11. Method according to claim 1, wherein the stream of fluid is heated to a temperature of between 50 and 200° C. so as to dry the materials that are to be extracted from the casting.

12. Method according to claim 1, wherein the fluid stream is restricted to a passage through the internal passages of the casting and to a space a few millimetres wide covering the outer envelope of the said casting.

13. Method for cleaning or decoring a casting, wherein, separately or in combination:

said casting is excited by an ultrasonic source of vibration, to allow residual material in contact with the walls of said casting to become detached, this casting resting on a number of anvils placed on vibrating means supporting the casting and in contact with a number of sonotrodes, said casting being initially subjected to a very low frequency so as to cause large-sized internal residue to crack up, imparting a low-frequency linear vibration, in higher range than the very low frequency, to the casting so as to break up and fluidize cracked bits, the material issuing forth from said casting is extracted using a stream of fluid, wherein the sonotrodes in contact with the casting are controlled by imparting to them a low-frequency oscillation of about 0.5 Hz of the pressing force between two thresholds of between about 100 and 1000 N.

14. Method for cleaning or decoring a casting, wherein, separately or in combination:

said casting is excited by an ultrasonic source of vibration, to allow residual material in contact with the walls of said casting to become detached, this casting resting on a number of anvils placed on vibrating means supporting the casting and in contact with a number of sonotrodes, said casting being initially subjected to a very low frequency so as to cause large-sized internal residue to crack up, imparting a low-frequency linear vibration, in higher range than the very low frequency, to the casting so as to break up and fluidize cracked bits, the material issuing forth from said casting is extracted using a stream of fluid, wherein the anvils in contact with the casting are controlled by imparting to them a low-frequency oscillation of about 0.5 Hz of the pressing force between two thresholds of between about 100 and 1000 N.

15. Method for cleaning or decoring a casting, wherein, separately or in combination:

said casting is excited by an ultrasonic source of vibration, to allow residual material in contact with the walls of said casting to become detached, this casting resting on a number of anvils placed on vibrating means supporting the casting and in contact with a number of sonotrodes, said casting being initially subjected to a very low frequency so as to cause large-sized internal residue to crack up, imparting a low-frequency linear vibration, in higher range than the very low frequency, to the casting so as to break up and fluidize cracked bits, the material issuing forth from said casting is extracted using a stream of fluid, wherein the sonotrodes in contact with the casting are controlled by imparting to them an oscillation or a pulsation at a frequency lower than the frequency of the ultrasonic source of the amplitude of vibration of these sonotrodes.

* * * * *